US011965141B2

(12) United States Patent
Qian et al.

(10) Patent No.: US 11,965,141 B2
(45) Date of Patent: Apr. 23, 2024

(54) FOOD-GRADE LUBRICATING GREASE AND METHOD FOR PREPARING SAME

(71) Applicant: Jiangnan University, Wuxi (CN)

(72) Inventors: Shanhua Qian, Wuxi (CN); Longfei Gong, Wuxi (CN); Wei Wang, Wuxi (CN); Zifeng Ni, Wuxi (CN); Juan Tang, Wuxi (CN)

(73) Assignee: JIANGNAN UNIVERSITY, Wuxi (CN)

( * ) Notice: Subject to any disclaimer, the term of this patent is extended or adjusted under 35 U.S.C. 154(b) by 0 days.

(21) Appl. No.: 17/973,687

(22) Filed: Oct. 26, 2022

(65) Prior Publication Data

US 2023/0068690 A1 Mar. 2, 2023

Related U.S. Application Data

(63) Continuation of application No. PCT/CN2020/103473, filed on Jul. 22, 2020.

(30) Foreign Application Priority Data

Apr. 28, 2020 (CN) ..... 202010348410.0

(51) Int. Cl.
*C10M 169/04* (2006.01)
*C10M 101/04* (2006.01)
(Continued)

(52) U.S. Cl.
CPC ..... *C10M 169/044* (2013.01); *C10M 101/04* (2013.01); *C10M 129/40* (2013.01);
(Continued)

(58) Field of Classification Search
CPC ..... C10M 169/044; C10M 101/04; C10M 129/40; C10M 129/50; C10M 139/00;
(Continued)

(56) References Cited

U.S. PATENT DOCUMENTS 5,037,563 A 8/1991 Pink et al.

FOREIGN PATENT DOCUMENTS

CN 101624549 A 1/2010
CN 102268320 * 12/2011
(Continued)

*Primary Examiner* — Cephia D Toomer
(74) *Attorney, Agent, or Firm* — IPRO, PLLC; Na Xu

(57) ABSTRACT

Disclosed is food-grade lubricating grease and a method for preparing the same, belonging to the technical field of lubricating grease. The food-grade lubricating grease is prepared from the following components in percentage by mass: 75% to 85% of food-grade white oil, 6% to 16% of stearic acid, 2.0% to 3.0% of benzoic acid, 4.7% to 8.7% of aluminum isopropoxide, 1.0% to 1.5% of water and 1.0% to 7.0% of nano-PTFE, and has good extreme-pressure, abrasion-resistant and friction-reduction properties, a last non-seizure load ($P_B$) reaching 411.6 N, a sintering load ($P_D$) reaching 1,960 N, and a friction coefficient reduced by 18.5%. The lubricating grease can be used for a food production industry and in household food appliances, the service life of a device and the service life of the food-grade lubricating grease are effectively prolonged, and meanwhile, food security is guaranteed to a certain degree.

9 Claims, 2 Drawing Sheets

(51) Int. Cl.

| | |
|---|---|
| ***C10M 129/40*** | (2006.01) |
| ***C10M 129/50*** | (2006.01) |
| ***C10M 139/00*** | (2006.01) |
| ***C10M 141/12*** | (2006.01) |
| ***C10M 147/00*** | (2006.01) |
| ***C10M 161/00*** | (2006.01) |
| ***C10M 177/00*** | (2006.01) |
| *C10N 20/02* | (2006.01) |
| *C10N 70/00* | (2006.01) |

(52) U.S. Cl.
CPC ..... *C10M 129/50* (2013.01); *C10M 139/00* (2013.01); *C10M 141/12* (2013.01); *C10M 147/00* (2013.01); *C10M 161/00* (2013.01); *C10M 177/00* (2013.01); *C10M 2203/1085* (2013.01); *C10M 2207/126* (2013.01); *C10M 2207/141* (2013.01); *C10M 2213/062* (2013.01); *C10M 2227/09* (2013.01); *C10N 2020/02* (2013.01); *C10N 2070/00* (2013.01)

(58) Field of Classification Search
CPC ..... C10M 141/12; C10M 147/00; C10M 161/00; C10M 177/00; C10M 2203/1085; C10M 2207/126; C10M 2207/141; C10M 2213/062; C10M 2227/09; C10M 2201/02; C10M 169/02; C10M 2203/1006; C10M 2207/021; C10M 2207/1256; C10M 2207/1265; C10M 2207/1415; C10M 2213/0626; C10M 2213/02; C10N 2020/02; C10N 2070/00; C10N 2010/06; C10N 2030/06; C10N 2030/62; C10N 2050/10
See application file for complete search history.

(56) References Cited

FOREIGN PATENT DOCUMENTS

| | | | | |
|---|---|---|---|---|
| CN | 102268320 | A | | 12/2011 |
| CN | 103789065 | A | | 5/2014 |
| CN | 103980991 | A | | 8/2014 |
| CN | 103981004 | A | | 8/2014 |
| CN | 104560314 | A | | 4/2015 |
| CN | 107686763 | | * | 2/2018 |
| CN | 109679736 | A | | 4/2019 |
| CN | 111394163 | A | | 7/2020 |
| KR | 101305080 | B1 | | 9/2013 |

* cited by examiner

FOOD-GRADE LUBRICATING GREASE AND METHOD FOR PREPARING SAME

TECHNICAL FIELD

The disclosure relates food-grade lubricating grease and a method for preparing the same, and belongs to the technical field of lubricating grease.

BACKGROUND

In recent years, food security issues have occurred frequently, more and more food security incidents have made people feel dreadful, and food security issues have become the focus of global attention. There are many factors affecting food security, among which, the contamination caused by lubricating materials is one of the main reasons leading to food security issues. Food machinery equipment is indispensable in a production and manufacturing process of food, and lubrication is necessary for each machinery device. In the production and manufacturing process of food, once lubricating materials leak, the lubricating materials may be easily mixed into the food, thus causing harm to food security. In order to avoid this problem, food-grade lubricating materials must be used in some links of food packaging and production. Food-grade lubricating grease is one of the components of food-grade lubricating materials and is used for lubricating, sealing and protecting the machinery device for food processing and packaging. Since work conditions of heating, steaming and boiling, etc. often occur in a food processing process, the food-grade lubricating grease also needs to have good high-temperature resistance, water resistance and non-toxic and harmless properties in addition to the characteristics of ordinary lubricating grease.

At present, little food-grade lubricating grease products produced in China meets the requirements, and most products on the market are foreign brands and are relatively expensive. Most of the existing food-grade lubricating materials are petrolatum, but the petrolatum has weak friction-reduction and abrasion-resistant effects and poor high-temperature resistance, and is not suitable for high-temperature steaming and boiling conditions such as soybean milk machines. Some scholars have also proposed that edible vegetable oil or animal oil (such as rapeseed oil and lard) may be used as lubricating materials for food machinery to achieve "non-toxic" effects, but this is "more harmful" because lard and rapeseed oil will deteriorate and go mouldy when being heated in a high-temperature and high-humidity environment, food-contaminating bacteria and the like may grow, and adverse effects will be brought to consumers after long-term use. Therefore, it is necessary to perform special researches on the food-grade lubricating grease. Complex aluminum base lubricating grease has been used in the food-grade lubricating grease due to its excellent properties such as high-temperature resistance and water resistance. Some scholars use trimeric aluminum as a thickening agent. However, the trimeric aluminum is an oil solvent, and most of the trimeric aluminum is an oil solvent for industrial use, and may cause contamination to the food-grade white oil, so the security cannot be guaranteed. With the improvement of national food security consciousness and the perfection of laws and regulations, the application of the food-grade lubricating grease will become wider and wider. Therefore, by improving a preparation process of the food-grade lubricating grease and obtaining the food-grade lubricating grease with low harm and long service life, the purpose of saving energy can be achieved, and meanwhile, people's sense on food security can be greatly satisfied.

SUMMARY

For the above problems, the disclosure provides food-grade lubricating grease and a method for preparing food-grade lubricating grease. The food-grade lubricating grease provided by the disclosure can be used for a food production industry and in household food appliances. The lubricating grease has good abrasion-resistant and friction-reduction properties, can bear a higher load, can effectively improve the transmission efficiency and service life of a transmission manner such as a gear, a guide rail, a chain and a bearing in food equipment, and is hopeful to become food-grade lubricating grease with good properties, low price and long service life to be applied to food production industries and to achieve the purpose of reducing food security issues and saving energy sources.

The disclosure provides a method for preparing food-grade lubricating grease. The food-grade lubricating grease is prepared from the following components in percentage by mass: 75% to 85% of food-grade white oil, 6% to 16% of stearic acid, 2.0% to 3.0% of benzoic acid, 5% to 8.7% of aluminum isopropoxide, 1.0% to 1.5% of water and 1.0% to 7.0% of nano-polytetrafluoroethylene (nano-PTFE).

The method for preparing food-grade lubricating grease includes the following steps:

(1) mixing the food-grade white oil and the aluminum isopropoxide with the benzoic acid, and performing heating to completely dissolve the mixture to obtain a mixture;

(2) adding the stearic acid into the dissolved mixture in step (1), and dissolving the stearic acid through stirring to obtain a corresponding product system A;

(3) adding water into the product system A obtained in step (2) for saponification, performing dewatering after the saponification is completed, then, adding the food-grade white oil, and raising the temperature for refining to obtain a product system B;

(4) adding the food-grade white oil into the product system B obtained in step (3) after temperature raising refining, and performing grinding after cooling to obtain food-grade lubricating grease base grease; and (5) mixing the food-grade lubricating grease base grease obtained in step (4) with food-grade nano-PTFE through stirring, and then, performing ultrasonic treatment and grinding to obtain the food-grade lubricating grease.

In an embodiment of the disclosure, the food-grade lubricating grease is prepared from the following components in percentage by mass: 78% to 82% of food-grade white oil, 10% to 12% of stearic acid, 2.0% to 3.0% of benzoic acid, 6.5% to 7.0% of aluminum isopropoxide, 1.0% to 1.5% of water and 5.0% to 7.0% of nano-PTFE.

In an embodiment of the disclosure, the food-grade lubricating grease is prepared from the following components in percentage by mass: 80% of food-grade white oil, 10.95% of stearic acid, 2.35% of benzoic acid, 6.69% of aluminum isopropoxide, 1.18% of water and 7% of nano-PTFE.

In an embodiment of the disclosure, the method for preparing food-grade lubricating grease includes the following steps:

(1) mixing the food-grade white oil and the aluminum isopropoxide with the benzoic acid, and performing heating to completely dissolve the mixture;

(2) adding the stearic acid into the dissolved mixture in step (1), and dissolving the stearic acid through stirring;

(3) adding water into a product obtained in step (2) for saponification, performing dewatering after the saponification, then, adding the food-grade white oil, and raising the temperature for refining;

(4) adding the food-grade white oil into a product obtained in step (3) after temperature raising refining, and performing grinding after cooling to obtain food-grade lubricating grease base grease; and (5) mixing the food-grade lubricating grease base grease with food-grade nano-PTFE through stirring, and then, performing ultrasonic treatment and grinding to obtain the food-grade lubricating grease.

In an embodiment of the disclosure, the food-grade white oil in step (1) conforms to specifications of the following standard: FDA 21 CFR 172.878, 178.3620 (a), 178.3570, and 176.170, and has passed NSF H1 and 3H certification.

In an embodiment of the disclosure, the heating in step (1) is performed at 95° C. to 110° C. for 30 min to 40 min.

In an embodiment of the disclosure, the food-grade white oil in step (1) has a kinematic viscosity (40° C.) of 28.8 cst to 33.5 cst.

In an embodiment of the disclosure, the saponification in step (3) is performed at 110° C. to 115° C. for 20 to 40 min.

In an embodiment of the disclosure, a treatment manner of the dewatering in step (3) is high-temperature dewatering, a dewatering temperature is 150° C. to 160° C., and the dewatering is performed at the saponification state, so that moisture in floccules after saponification is evaporated until the floccules after saponification are scattered to present a blocky state.

In an embodiment of the disclosure, the temperature raising refining in step (3) is performed at 200° C. to 210° C. for 20 min to 40 min.

In an embodiment of the disclosure, the grinding in step (4) is performed by utilizing a three-roller grinder for 2 to 5 times.

In an embodiment of the disclosure, the mass percentage of the food-grade nano-PTFE in step (5) is 7%.

In an embodiment of the disclosure, an amount of the food-grade white oil in step (1) accounts for 50% to 55% of a total amount of use of the food-grade white oil, an amount of the food-grade white oil in step (3) accounts for 20% to 25% of the total amount of use of the food-grade white oil, and an amount of the food-grade white oil in step (4) accounts for 25% to 30% of the total amount of use of the food-grade white oil.

In an embodiment of the disclosure, an amount of the food-grade white oil in step (1) accounts for 50% of a total amount of use of the food-grade white oil, an amount of the food-grade white oil in step (3) accounts for 25% of the total amount of use of the food-grade white oil, and an amount of the food-grade white oil in step (4) accounts for 25% of the total amount of use of the food-grade white oil.

In an embodiment of the disclosure, the stirring in step (5) is performed for 5 min to 30 min.

In an embodiment of the disclosure, a manner of the ultrasonic treatment in step (5) is vibration in an ultrasonic cleaner for 10 min to 20 min.

The disclosure provides food-grade lubricating grease prepared by the method for preparing food-grade lubricating grease.

The disclosure provides food-grade lubricating grease base grease prepared in steps (1) to (4) according to the method for preparing food-grade lubricating grease.

The disclosure provides application of the food-grade lubricating grease to food machinery devices.

The disclosure has the following beneficial effects:

1. A dropping point of the food-grade lubricating grease in the disclosure is higher than 300° C., a last non-seizure load ($P_B$) is 350 N or higher, and a sintering load ($P_D$) is 1,568 N or higher. In a preferable scheme, the last non-seizure load ($P_B$) reaches 411.6 N, a sintering load ($P_D$) reaches 1,960 N, and a friction coefficient is reduced by 18.5%.

2. The food-grade lubricating grease in the disclosure uses food-grade white oil as base oil. The food-grade white oil is obtained by using mineral oil as base oil through being treated by processes such as deep chemical refining and edible alcohol extraction, is applicable to lubrication of processing devices for grain and oil processing, fruit and vegetable processing, dairy product processing and food industry processing such as breading cutters, can be applied to food glazing, anti-sticking, defoaming, scraping and sealing, and can prolong the storage period and refreshing time of wine, vinegar, fruits, vegetables and cans when being used as a mold release agent of food such as macaronies, bread, biscuits and chocolate. Therefore, the security of the lubricating grease can be guaranteed to a certain degree by using the food-grade white oil as the food-grade lubricating grease base grease.

3. An additive of the food-grade lubricating grease of the disclosure is food-grade nano-PTFE. The nano-PTFE has excellent properties of high-temperature resistance, low-temperature resistance, corrosion resistance, high lubrication, no toxicity, harmlessness, etc. By using the nano-PTFE as the additive of the lubricating grease, the friction-reduction and abrasion-resistant properties of the lubricating grease can be enhanced, and the security can be guaranteed.

4. The food-grade lubricating grease of the disclosure uses a complex aluminum base as a thickening agent. Complex aluminum base lubricating grease has properties of high dropping point, high-temperature resistance, good water resistance, anti-rust properties, etc., and is thus applicable to work conditions of heating, steaming and boiling, etc. often occurring in a food processing process in food machinery industries.

DETAILED DESCRIPTION

The disclosure will be further illustrated with reference to specific examples. It should be understood that these examples are only used for illustrating the disclosure and are not intended to limit the scope of the disclosure. Additionally, it should be understood that those skilled in the art can make various changes or modifications on the disclosure after reading the disclosure, and these equivalent forms all fall within the scope of the appended claims.

Raw materials used in examples and comparative examples of the disclosure are as shown in the following table, but are not limited to the materials manufactured by the listed manufacturers.

TABLE 1

| Raw Materials | |
|---|---|
| Raw material | Manufacturer |
| Food-grade white oil | MOROKE |
| Stearic acid | Sinopharm Chemical Reagent Co., Ltd. |
| Benzoic acid | Sinopharm Chemical Reagent Co., Ltd. |
| Aluminum isopropoxide | Shanghai Macklin Biochemical Co., Ltd. |
| Nano-PTFE | DuPont Co. America |

EXAMPLE 1

(1) Firstly, 400 g of food-grade white oil, 66.9 g of aluminum isopropoxide and 23.5 g of benzoic acid were added into a reaction kettle. Heating was performed to control a temperature in a range between 95° C. and 100° C. Stirring was performed to completely dissolve the mixture.

(2) Then, 109.5 g of stearic acid was added into the dissolved mixture in step (1). Stirring was performed for 30 min to enable the stearic acid to sufficiently dissolve and react.

(3) Then, 11.8 g of water was sprayed in a linear manner into a product obtained in step (2). Saponification was performed at a temperature of 110° C. to 115° C. for 30 min. The temperature was raised to 160° C. to perform dewatering for 20 min, so that moisture in floccules after saponification was evaporated until the floccules after saponification were scattered to present a blocky state. Then, 200 g of food-grade white oil was added into the floccules. The temperature was raised to 200° C. to 210° C. for high-temperature refining for 30 min.

(4) Finally, 200 g of food-grade white oil was added into a product obtained in step (3) after temperature raising refining. Rapid cooling was performed. After stirring cooling, grinding was performed by using an S65 three-roller grinder for 3 times. Food-grade lubricating grease base grease was obtained.

(5) 100 g of the food-grade lubricating grease base grease and food-grade nano-PTFE with the mass percentage of 7.0% were taken, put into a flask and uniformly stirred for 10 min, and were then vibrated in an ultrasonic cleaner for 10 min. Grinding was performed through a three-roller grinder for three times to obtain the food-grade lubricating grease containing a 7.0% food-grade nano-PTFE additive.

Figure 1:
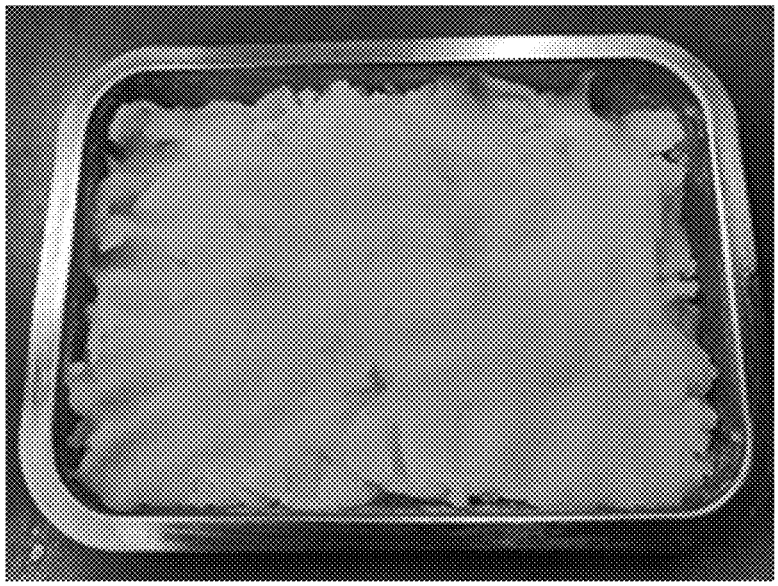
FIG. 1 is a photo of food-grade lubricating grease prepared according to Example 1.

FIG. 1 is a photo of food-grade lubricating grease prepared according to this example. From FIG. 1, it can be seen that the prepared food-grade lubricating grease is pure white with no other impurities and no special odor, and the prepared food-grade lubricating grease has good viscosity, hardness, etc.

EXAMPLE 2

(1) to (4) were the same as steps (1) to (4) in Example 1.

(5) 100 g of the food-grade lubricating grease base grease and food-grade nano-PTFE with the mass percentage of 1.0% were taken, put into a flask and uniformly stirred for 10 min, and were then vibrated in an ultrasonic cleaner for 10 min. Grinding was performed through a three-roller grinder for three times to obtain the food-grade lubricating grease containing a 1.0% food-grade nano-PTFE additive.

EXAMPLE 3

(1) to (4) were the same as steps (1) to (4) in Example 1.

(5) 100 g of the food-grade lubricating grease base grease and food-grade nano-PTFE with the mass percentage of 3.0% were taken, put into a flask and uniformly stirred for 10 min, and were then vibrated in an ultrasonic cleaner for 10 min. Grinding was performed through a three-roller grinder for three times to obtain the food-grade lubricating grease containing a 3.0% food-grade nano-PTFE additive.

EXAMPLE 4

(1) to (4) were the same as steps (1) to (4) in Example 1.

(5) 100 g of the food-grade lubricating grease base grease and food-grade nano-PTFE with the mass percentage of 5.0% were taken, put into a flask and uniformly stirred for 10 min, and were then vibrated in an ultrasonic cleaner for 10 min. Grinding was performed through a three-roller grinder for three times to obtain the food-grade lubricating grease containing a 5.0% food-grade nano-PTFE additive.

EXAMPLE 5

(1) Firstly, 375 g of food-grade white oil, 66.9 g of aluminum isopropoxide and 23.5 g of benzoic acid were added into a reaction kettle. Heating was performed to control a temperature in a range between 95° C. and 100° C. Stirring was performed to completely dissolve the mixture.

(2) Then, 109.5 g of stearic acid was added into the dissolved mixture in step (1). Stirring was performed for 30 min to enable the stearic acid to sufficiently dissolve and react.

(3) Then, 11.8 g of water was sprayed in a linear manner into a product obtained in step (2). Saponification was performed at a temperature of 110° C. to 115° C. for 30 min. The temperature was raised to 160° C. to perform dewatering for 20 min, so that moisture in floccules after saponification was evaporated until the floccules after saponification were scattered to present a blocky state. Then, 187.5 g of food-grade white oil was added into the floccules. The temperature was raised to 200° C. to 210° C. for high-temperature refining for 30 min.

(4) Finally, 187.5 g of food-grade white oil was added into a product obtained in step (3) after temperature raising refining. Rapid cooling was performed. After stirring cooling, grinding was performed by using an S65 three-roller grinder for 3 times. Food-grade lubricating grease base grease was obtained.

(5) 100 g of the food-grade lubricating grease base grease and food-grade nano-PTFE with the mass percentage of 7.0% were taken, put into a flask and uniformly stirred for 10 min, and were then vibrated in an ultrasonic cleaner for 10 min. Grinding was performed through a three-roller grinder for three times to obtain the food-grade lubricating grease containing a 7.0% food-grade nano-PTFE additive.

EXAMPLE 6

(1) Firstly, 425 g of food-grade white oil, 66.9 g of aluminum isopropoxide and 23.5 g of benzoic acid were added into a reaction kettle. Heating was performed to control a temperature in a range between 95° C. and 100° C. Stirring was performed to completely dissolve the mixture.

(2) Then, 109.5 g of stearic acid was added into the dissolved mixture in step (1). Stirring was performed for 30 min to enable the stearic acid to sufficiently dissolve and react.

(3) Then, 11.8 g of water was sprayed in a linear manner into a product obtained in step (2). Saponification was performed at the temperature of 110° C. to 115° C. for 30 min. The temperature was raised to 160° C. to perform dewatering for 20 min, so that moisture in floccules after saponification was evaporated until the floccules after saponification were scattered to present a blocky state. Then, 212.5 g of food-grade white oil was added into the floccules. The temperature was raised to 200° C. to 210° C. for high-temperature refining for 30 min.

(4) Finally, 212.5 g of food-grade white oil was added into a product obtained in step (3) after temperature raising refining. Rapid cooling was performed. After stirring cooling, grinding was performed by using an S65 three-roller grinder for 3 times. Food-grade lubricating grease base grease was obtained.

(5) 100 g of the food-grade lubricating grease base grease and food-grade nano-PTFE with the mass percentage of 7.0% were taken, put into a flask and uniformly stirred for 10 min, and were then vibrated in an ultrasonic cleaner for 10 min. Grinding was performed through a three-roller grinder for three times to obtain the food-grade lubricating grease containing a 7.0% food-grade nano-PTFE additive.

Comparative Example 1

The aluminum isopropoxide in step (1) in Example 1 was replaced with trimeric aluminum. Other preparation methods were the same as those in Example 1.

When a thickening agent was changed into the trimeric aluminum, a color of the prepared lubricating grease would change, and the security could not be guaranteed. The trimeric aluminum was an oil solvent, and was mostly prepared from industrial oil, so its color was mostly tan. Additionally, the industrial oil might cause certain contamination on the food-grade white oil, so that the security could not be guaranteed. Therefore, by comparison, the color and security of the food-grade lubricating grease prepared in Example 1 were better than those in Comparative example 1.

Comparative Example 2

(1) Firstly, 400 g of food-grade white oil, 109.5 g of stearic acid and 23.5 g of benzoic acid were added into a reaction kettle. Heating was performed to control a temperature in a range between 95° C. and 100° C. Stirring was performed to completely dissolve the mixture.

(2) Then, 66.9 g of aluminum isopropoxide was added into the dissolved mixture in step (1). Stirring was performed for 30 min to enable the aluminum isopropoxide to sufficiently dissolve and react.

(3) to (5) were the same as steps (3) to (5) in Example 1. Food-grade lubricating grease containing a 7.0% food-grade nano-PTFE additive was obtained.

Comparative Example 3

An operation of adding white oil in three times in steps (1), (3) and (4) in Example 1 was replaced with an operation of adding 800 g of white oil in step (1) but adding no white oil in steps (3) and (4), and other preparation methods and processes were the same as those in Example 1.

EXAMPLE 7 PROPERTY TEST

Physical and Chemical Property Test

Physical and chemical property characterization is performed on the lubricating grease prepared in Example 1, Example 5, Example 6, Comparative example 2 and Comparative example 3 by utilizing an SYP4100-I lubricating grease penetration tester (Shanghai Jingxi Instrument Manufacturing Co., Ltd.), an SYD-4929 lubricating grease dropping point tester (Shanghai Changji Geological instrument Co., Ltd.) and an SYD-0324 lubricating grease steel mesh oil separation tester (Shanghai Jingxi Instrument Manufacturing Co., Ltd.). The results are as shown in Table 2.

TABLE 2

| Physical and chemical properties | | | |
|---|---|---|---|
| Items | Steel mesh oil separation (100° C., 30 h)/% | ¼ penetration, 0.1 mm | Dropping point/° C. |
| Example 1 | 1.92 | 65 | >300 |
| Example 5 | 1.85 | 63 | >300 |
| Example 6 | 2.21 | 70 | 260 |
| Comparative example 2 | 1.98 | 75 | 285 |
| Comparative example 3 | 1.86 | 82 | 232 |

From Table 2, it can be seen that when the amount of the food-grade white oil is changed from 80% in Example 1 into 75% in Example 5, the hardness of the prepared food-grade lubricating grease is higher, that is, the penetration is lower, the viscosity is poorer than that under the condition of 80% amount, and the lubricating grease is inconvenient to bring and suck into a friction gap. When the amount of the food-grade white oil is changed from 80% in Example 1 into 85% in Example 6, the prepared food-grade lubricating grease is thin, the penetration is higher, the still standing oil separation is much, the properties are poorer than that under the condition of 80% amount, and this lubricating grease is not applicable to high-temperature or steaming and boiling work conditions. The dropping point of the lubricating grease prepared in Comparative example 2 is lower than that in Example 1, the penetration and the steel mesh oil separation indexes are higher than those in Example 1, and the properties are relatively poorer. In Comparative example 3, the while oil was added in one step, and rapid cooling is not performed after high-temperature refining is completed, so that its physical and chemical properties are relatively poorer, its penetration is higher, the lubricating grease is softer, and its dropping point is relatively lower. On the whole, the lubricating grease prepared in Example 1 has better properties, realize complete saponification, and is more applicable to high-temperature or steaming and boiling work conditions of food machinery. Therefore, the influence of food-grade nano-PTFE of different contents on the extreme-pressure, friction-reduction and abrasion-resistant properties of the lubricating grease will be investigated hereafter based on Example 1.

Extreme-Pressure Property Test and Friction and Abrasion Property Test

Figure 2:
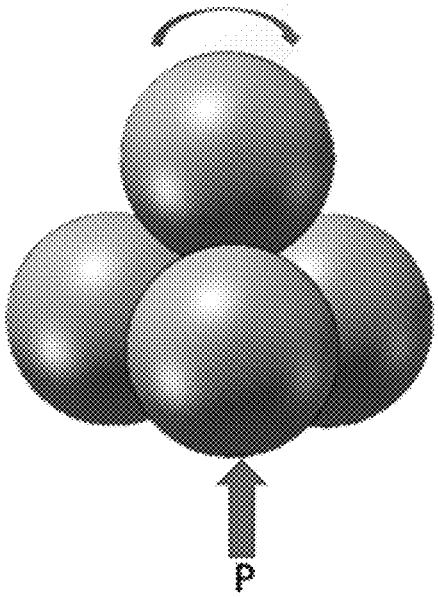
FIG. 2 is a schematic diagram of MS-10A four-ball friction used in Example 7.

Extreme-pressure property tests were performed on a food-grade lubricating grease test specimen by using an MS-10A four-ball friction tester (Xiamen Tenkey Automation Co., Ltd.). A schematic diagram of a device in the tests is as shown in FIG. 2. In the whole test process, an upper steel ball was pressed down to be in contact with three steel balls (GCr15, diameter: 12.7 mm, and Rockwell hardness: 64 to 66 HRC) fixed at a lower portion. According to the Standard SH/T 0202-94, all the tests were performed under the test conditions that the rotating speed was 1,770 r/min, the time was 10 s, the temperature was 20° C., the last non-seizure load ($P_B$) was locked to 68 Nm in the test, the sintering load ($P_D$) was locked to 100 Nm in the test. The steel balls were subjected to ultrasonic cleaning by petroleum ether for 10 min before and after each test.

Figure 3:
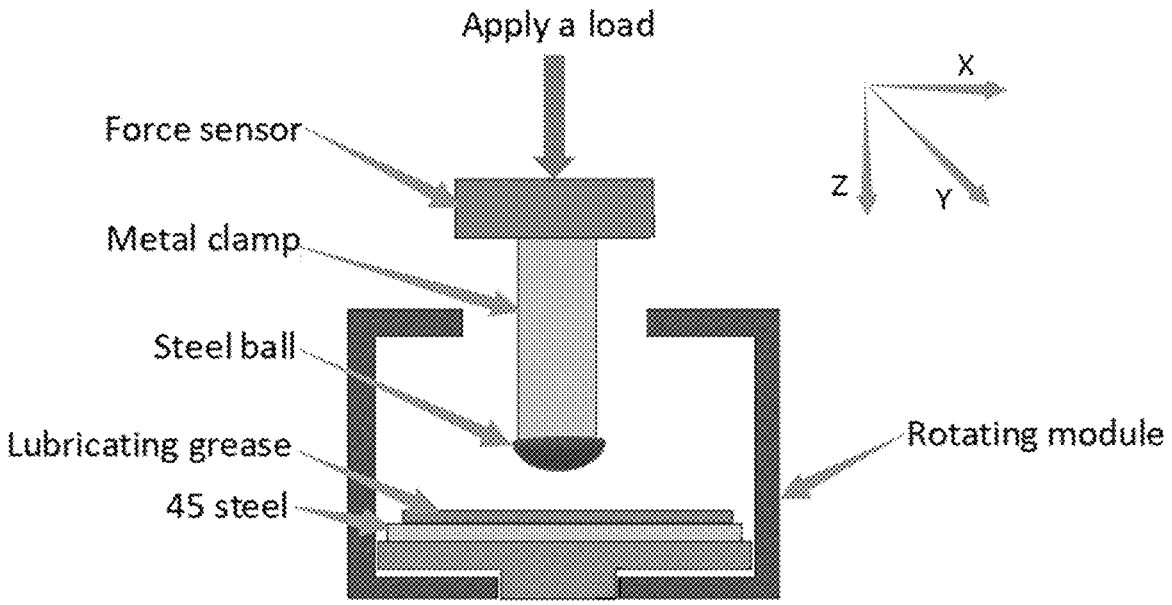
FIG. 3 is a schematic diagram of MFT-5000 friction and abrasion testers used in Example 7.

The food-grade lubricating grease in the above examples was subjected to friction and abrasion property test by using MFT-5000 friction and abrasion testers (Rtec instruments). A schematic diagram of the MFT-5000 friction and abrasion testers (Rtec instruments) is as shown in FIG. 3. The steel balls used in the tests were made of GCr15, and friction disks used in the tests were made of 45 steel. Test parameters such as load, rotating speed and time were set before the tests.

The test results of the above examples are as shown in Table 3.

TABLE 3

Results of extreme-pressure property and friction tests

| Items | Content of nano-PTFE | Last non-seizure load ($P_B$) (N) | Sintering load ($P_D$) (N) | Friction coefficient (COF) |
|---|---|---|---|---|
| Base grease in Example 1 | 0% | 333.2 | 1234.8 | 0.119 |
| Lubricating grease in Example 1 | 7.0% | 411.6 | 1960.0 | 0.097 |
| Lubricating grease in Example 2 | 1.0% | 352.8 | 1568.0 | 0.159 |
| Lubricating grease in Example 3 | 3.0% | 392.0 | 1960.0 | 0.116 |
| Lubricating grease in Example 4 | 5.0% | 392.0 | 1568.0 | 0.066 |

From Table 3, it can be seen that when the food-grade nano-PTFE is used as a food-grade lubricating grease base grease additive, and a concentration of the food-grade nano-PTFE is respectively increased from 0.0% to 7.0%, the last non-seizure load ($P_B$) and the sintering load ($P_D$) are obviously increased. In a process of testing the extreme-pressure by using the four-ball friction and abrasion tester, with the continuous increase of the exerted load, the lubricating form between friction pairs accordingly change. Under a low-load work condition, the lubricating form between the friction pairs mainly relies on the lubrication of full-membrane fluid formed through lubricating grease flowing. Along with the load increase, the lubricating form is transited from full-membrane fluid lubrication to elastic fluid dynamic lubrication, mixed lubrication and boundary lubrication. A value of the last non-seizure load ($P_B$) represents a bearing capacity of a boundary membrane, and is mainly related to adsorption properties (physical adsorption or chemical adsorption) of the additive. A value of the sintering load ($P_D$) is a maximum value of a bearing capacity of a chemical membrane, and is mainly related to a chemical reaction and an additive concentration. Therefore, when the food-grade nano-PTFE is added into the food-grade lubricating grease base grease to be used as an additive, the last non-seizure load ($P_B$) of the food-grade lubricating grease can be obviously increased. Compared with that of the food-grade lubricating grease base grease, the $P_B$ can be improved by 24% by the 7.0% food-grade nano-PTFE. The result show that the PTFE has good adsorption properties, and can increase the bearing capacity of the boundary membrane through an adsorption effect. When concentrations of the added food-grade nano-PTFE are 3.0% and 7.0%, a value of $P_D$ of the food-grade lubricating grease test specimen is optimum (1,960 N, g=9.8 m/s$^2$). When a concentration of the added food-grade nano-PTFE is 5.0%, a value of $P_D$ of is slightly decreased, and this may be caused by weak chemical reactivity at the nano-PTFE content of 5.0%. Any one reaction has certain reversibility, and in a lubricating process, ingredients of the food-grade lubricating grease may take a certain chemical reaction, so when the content of the nano-PTFE is 5.0%, the chemical reactivity cooperativity between them are weak. However, on the whole, when the content of the nano-PTFE is 5.0%, the value of $P_D$ is better than that of the base grease. Compared with that of the base grease, the value of $P_D$ can be improved by 59% through 3.0% food-grade nano-PTFE and 7.0% food-grade nano-PTFE. This shows that the bearing capacity of a chemical reaction membrane at this moment is best.

Figure 4:
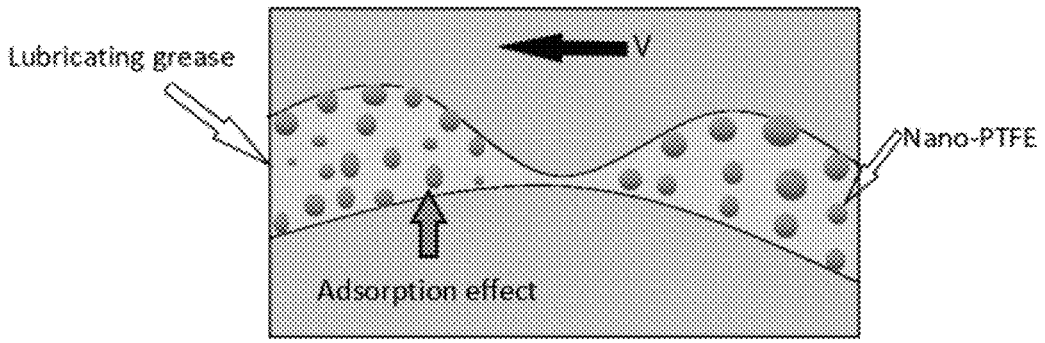
FIG. 4 is a schematic diagram of a friction-reduction principle of food-grade nano-PTFE.

From Table 3, it can be known that the friction-reduction and abrasion-resistant properties of the food-grade lubricating grease can be improved by adding the food-grade nano-PTFE. By adding the food-grade nano-PTFE, the friction coefficient of the food-grade lubricating grease can be reduced. Due to an agglomeration phenomenon of nano-particles, the friction coefficient may fluctuate to a certain degree. Therefore, more is not better. A friction-reduction mechanism of the nano-PTFE is mainly achieved through obstruction on the direct contact of the friction pairs by the boundary membrane generated through the adsorption effect, and its principle diagram is shown in FIG. 4. For achieving the comprehensive effect of the extreme-pressure property and the wear-resistant property, Example 1 can be used as an optimum recipe for the food-grade lubricating grease.

Although the exemplary examples of the disclosure have been disclosed above, they are not intended to limit the disclosure. Those skilled in the art may make various changes and modifications without departing from the scope and spirit of the disclosure. Therefore, the protection scope of the disclosure should be determined by the claims.

What is claimed is:

1. A method for preparing food-grade lubricating grease, wherein the food-grade lubricating grease comprises the following components in percentage by mass: 75% to 85% of food-grade white oil, 6% to 16% of stearic acid, 2.0% to 3.0% of benzoic acid, 5% to 8.7% of aluminum isopropoxide, 1.0% to 1.5% of water and 1.0% to 7.0% of nano-PTFE; and the method comprises the following steps:

(1) mixing the food-grade white oil and the aluminum isopropoxide with the benzoic acid, and performing heating to completely dissolve the mixture to obtain a dissolved mixture;

(2) adding the stearic acid into the dissolved mixture in step (1), and dissolving the stearic acid through stirring to obtain a corresponding product system A;

(3) adding water into the product system A obtained in step (2) for saponification, performing dewatering after the saponification is completed, then, adding a second portion of the food-grade white oil, and raising the temperature for refining to obtain a product system B;

(4) adding a third portion of the food-grade white oil into the product system B obtained in step (3) after temperature raising refining, and performing grinding after cooling to obtain food-grade lubricating grease base grease; and (5) mixing the food-grade lubricating grease base grease obtained in step (4) with food-grade nano-PTFE through stirring, and then, performing ultrasonic treatment and grinding to obtain the food-grade lubricating grease.

2. The method for preparing food-grade lubricating grease according to claim 1, wherein the food-grade lubricating grease comprises the following components in percentage by mass: 78% to 82% of food-grade white oil, 10% to 12% of stearic acid, 2.0% to 3.0% of benzoic acid, 6.5% to 7.0% of aluminum isopropoxide, 1.0% to 1.5% of water and 5.0% to 7.0% of nano-PTFE.

3. The method for preparing food-grade lubricating grease according to claim 1, wherein the food-grade white oil in step (1) has a kinematic viscosity of 28.8 cst to 33.5 cst at 40° C.

4. The method for preparing food-grade lubricating grease according to claim 1, wherein the heating in step (1) is performed at 95° C. to 110° C. for 30 minutes to 40 minutes.

5. The method for preparing food-grade lubricating grease according to claim 1, wherein the saponification in step (3) is performed at 110° C. to 115° C. for 20 minutes to 40 minutes.

6. The method for preparing food-grade lubricating grease according to claim 1, wherein the temperature raising refining is performed at 200° C. to 210° C. for 20 minutes to 40 minutes.

7. The method for preparing food-grade lubricating grease according to claim 1, wherein an amount of the food-grade white oil in step (1) accounts for 50% to 55% of a total amount of use of the food-grade white oil, an amount of the food-grade white oil in step (3) accounts for 20% to 25% of the total amount of use of the food-grade white oil, and an amount of the food-grade white oil in step (4) accounts for 25% to 30% of the total amount of use of the food-grade white oil.

8. The method for preparing food-grade lubricating grease according to claim 1, wherein an amount of the food-grade white oil in step (1) accounts for 50% of a total amount of use of the food-grade white oil, an amount of the food-grade white oil in step (3) accounts for 25% of the total amount of use of the food-grade white oil, and an amount of the food-grade white oil in step (4) accounts for 25% of the total amount of use of the food-grade white oil.

9. The method for preparing food-grade lubricating grease according to claim 1, wherein the mass percentage of the food-grade nano-PTFE in step (5) is 7%.

* * * * *